US006831504B1

(12) United States Patent
Holloway et al.

(10) Patent No.: US 6,831,504 B1
(45) Date of Patent: Dec. 14, 2004

(54) CONSTANT TEMPERATURE COEFFICIENT SELF-REGULATING CMOS CURRENT SOURCE

(75) Inventors: Peter R. Holloway, Groveland, MA (US); Eric D. Blom, Wakefield, MA (US); Jun Wan, Haverhill, MA (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 10/402,447

(22) Filed: Mar. 27, 2003

(51) Int. Cl.[7] ..... G05F 3/24; G05F 3/26
(52) U.S. Cl. ..... 327/541; 327/543; 323/315
(58) Field of Search ..... 327/512, 513, 327/538, 540, 541, 543, 539; 323/312–315, 907

(56) References Cited

U.S. PATENT DOCUMENTS

| | | | | |
|---|---|---|---|---|
| 4,593,208 A | | 6/1986 | Single | 327/539 |
| 5,646,518 A | | 7/1997 | Lakshmikumar et al. | 323/316 |
| 5,774,013 A | | 6/1998 | Groe | 327/543 |
| 5,828,329 A | | 10/1998 | Burns | 341/155 |
| 5,838,191 A | | 11/1998 | Opris et al. | 327/539 |
| 5,936,392 A | | 8/1999 | Taylor | 323/315 |
| 6,091,286 A | | 7/2000 | Blauschild | 327/543 |
| 6,147,550 A | * | 11/2000 | Holloway | 327/544 |
| 6,160,393 A | * | 12/2000 | Ahn et al. | 323/315 |
| 6,346,848 B1 | | 2/2002 | Shkap | 327/538 |
| 6,417,724 B1 | | 7/2002 | Taylor | 327/538 |

FOREIGN PATENT DOCUMENTS

GB 2031193 A * 4/1980 ..... G05F/3/16

OTHER PUBLICATIONS

Eric Vittoz, Jean Fellrath, "CMOS Analog Integrated Circuits Based on Weak Inversion Operation", IEEE Journal of Solid–State Circuits, vol. SC–12, No. 3, Jun. 1977, pp. 224–231.

* cited by examiner

*Primary Examiner*—Timothy P. Callahan
*Assistant Examiner*—Terry L. Englund
(74) *Attorney, Agent, or Firm*—Patent Law Group LLP; Carmen C. Cook

(57) ABSTRACT

A current source includes a first circuit branch of a pair of diode-connected transistors with a resistor connected at the drain terminal and a second circuit branch of an inverter pair of transistors. Both of the circuit branches are supplied by a first current source powered by a supply voltage. The transistors are biased in the subthreshold region and have non-nominal size ratios. A first voltage and a second voltage are established across the resistor and the voltage difference causes a current proportional to absolute temperature to flow in the resistor. The second circuit branch functions as an error amplifier providing an "error signal" to facilitate voltage regulation. The regulation is realized in a third circuit branch which receives the "error signal" and draws excess current from the first current source so that the first voltage and the second voltage remain at the ideal regulated operation point.

34 Claims, 5 Drawing Sheets

CONSTANT TEMPERATURE COEFFICIENT SELF-REGULATING CMOS CURRENT SOURCE

CROSS-REFERENCE TO RELATED APPLICATIONS

This application is related to the following concurrently filed and commonly assigned U.S. patent applications: U.S. patent application Ser. No. 10/402,653, entitled "Digitizing Temperature Measurement System," of Peter R. Holloway et al.; U.S. patent application Ser. No. 10/401,835, entitled "Low Noise Correlated Double Sampling Modulation System," of Peter R. Holloway et al.; and U.S. patent application Ser. No. 10/402,080, entitled "A Constant RON Switch Circuit with Low Distortion and Reduction of Pedestal Errors," of Peter R. Holloway. The aforementioned patent applications are incorporated herein by reference in their entireties.

FIELD OF THE INVENTION

The invention relates to constant temperature coefficient current sources and, in particular, to a constant positive temperature coefficient current source having improved power supply rejection ratio.

DETAILED DESCRIPTION OF THE PREFERRED EMBODIMENTS

In accordance with the principles of the present invention, a current source for generating an output current having constant temperature coefficient and high power supply rejection ratio (PSRR) uses a pair of diode-connected MOS transistors in parallel with a pair of inverter connected MOS transistors. The diode-connected MOS transistors are sized in a non-nominal manner such that when operated at a given current level, the common gate voltage of the transistor pair is at a first voltage. In contrast, the inverter connected MOS transistors are sized in a non-nominal manner such that the threshold voltage of the inverter pair at the same current level is at a voltage greater than the first voltage. The diode-connected MOS transistors and the inverter connected MOS transistors are biased in the subthreshold region to ensure that a reference voltage generated within the current source is a voltage proportional to absolute temperature (PTAT). This PTAT voltage is impressed across a resistor to set the output current. The output current of the current source exhibits a constant temperature coefficient over a wide temperature range and exhibits nearly zero power supply dependency over a wide power supply voltage range.

Linear analog circuits generally require DC biasing circuits to provide the bias currents and voltages needed for proper operation. While DC biasing circuits can be implemented using a voltage reference, reference currents are typically used as the basis for the bias circuits. In some applications, a reference current can be made to exhibit a known linear change with temperature. In that case, the reference current can be used simultaneously to bias analog circuitry and to control temperature sensing circuitry. In temperature sensing applications, it is desirable that any change in the reference current be derived from temperature change only and that changes in the power supply voltage do not induce changes to the reference current. The current source of the present invention provides an output current with constant positive temperature coefficient and near zero supply voltage dependence and is thus ideal for use in DC biasing circuits, especially in temperature sensing applications.

Circuit Overview

Figure 1:
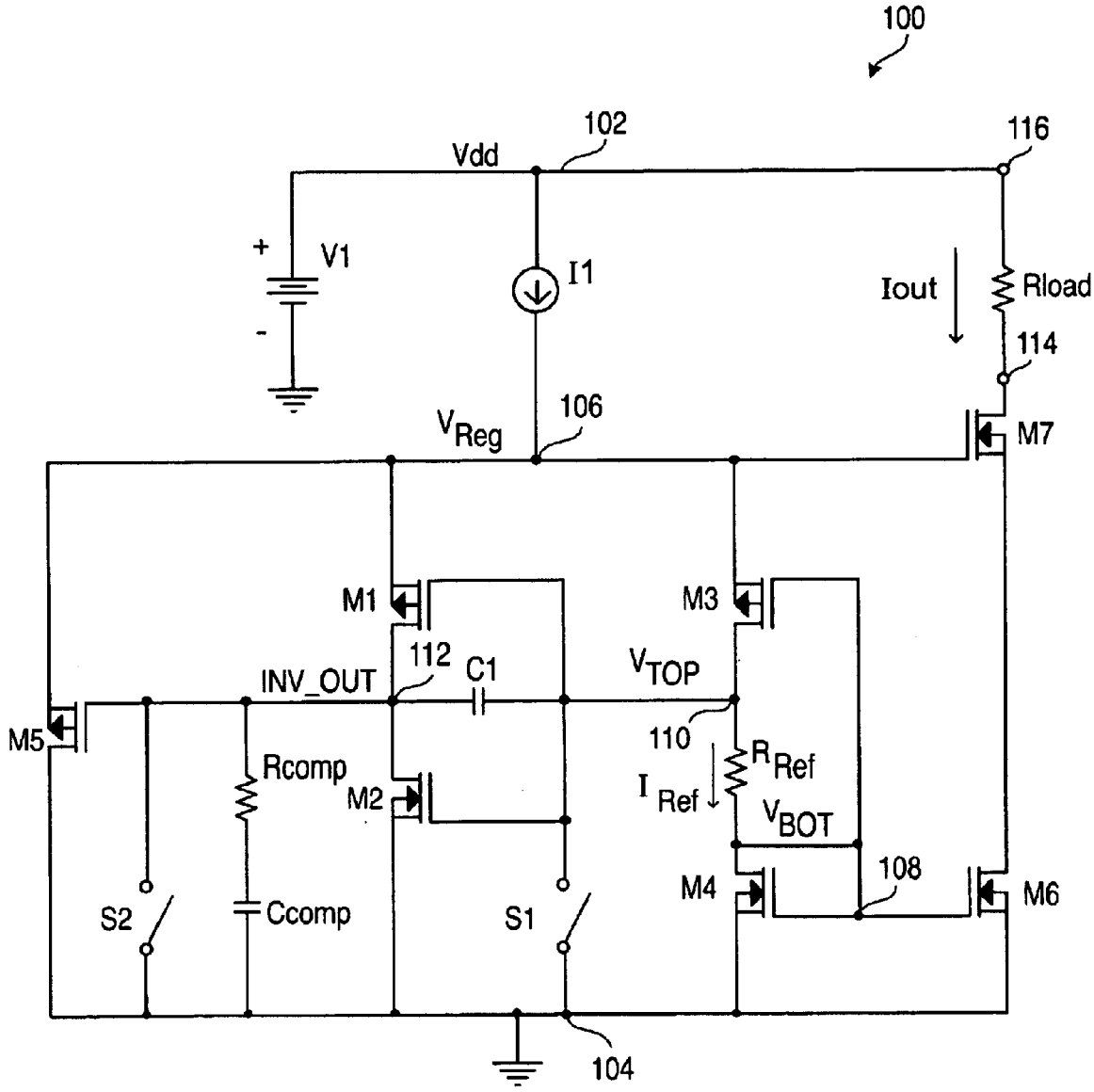
FIG. 1 is a circuit diagram of a constant temperature coefficient self-regulating current source according to one embodiment of the present invention.

FIG. 1 is a circuit diagram of a constant temperature coefficient self-regulating current source according to one embodiment of the present invention. Referring to FIG. 1, current source 100 includes a voltage source V1 supplying a Vdd voltage on a node 102 and a current source I1 coupled between the Vdd voltage and a regulated voltage $V_{Reg}$ at a node 106. Current source I1, powered by the Vdd voltage, supplies a current (also referred herein as current I1) to circuit branches connected to the regulated voltage $V_{Reg}$. In the present embodiment, current source 100 includes a first circuit branch of diode-connected MOS transistors, a second circuit branch of inverter-connected MOS transistors and a third circuit branch including a shunt regulator. As will be explained in more detail below, the circuit branches draw current from current source I1 in a manner so as to regulate the voltage $V_{Reg}$ at node 106 despite variations in the Vdd voltage. In the present embodiment, current source I1 is a stand alone current source and supplies a fixed current I1. In other embodiments, current source I1 can derive its operating current value from the current source itself, as will be explained below. In the present embodiment, voltage source V1 provides a Vdd voltage of 2.4 Volts to 5.5 Volts and current source I1 provides a current value of 20 $\mu$A.

The first circuit branch of current source 100 includes a PMOS transistor M3 and an NMOS transistor M4 connected in series with a resistor $R_{Ref}$ at the drain terminals. Specifically, PMOS transistor M3 has a source terminal connected to the regulated voltage node 106, a drain terminal connected to a node 110 and a gate terminal connected to a node 108. Transistor M3 is diode-connected by connecting the gate and the drain terminals of the transistor together through resistor $R_{Ref}$. NMOS transistor M4 has a source terminal connected to the ground potential (node 104), and a drain terminal and a gate terminal both connected to node 108. Thus, transistor M4 is diode-connected. PMOS transistor M3 and NMOS transistor M4 are not nominally sized. In a nominally sized transistor pair, the PMOS transistor is sized two times larger than the NMOS transistor to account for the lower hole mobility. However, in the present embodiment, PMOS transistor M3 has a width to length ratio of 30:1 while NMOS transistor M4 has a width to length ratio of 60:1. Thus, when carrier mobility is taken into consideration, NMOS transistor M4 is two times as strong as PMOS transistor M3. In the present embodiment, resistor $R_{Ref}$ is a polysilicon resistor and has a nominal resistance of 36.5 kΩ.

Transistors M3 and M4 generate a voltage $V_{top}$ at node 110 and a voltage $V_{bot}$ at node 108 across resistor $R_{Ref}$. When the transistors in current source 100 are biased in the subthreshold region, the difference between voltage $V_{top}$ and voltage $V_{bot}$, referred herein as the reference voltage $V_{Ref}$, is a voltage proportional to absolute temperature (a PTAT voltage), as will be described in more detail below. By impressing the reference voltage $V_{Ref}$ across resistor $R_{Ref}$, a nearly PTAT current is generated. In the present description, the nearly PTAT current flowing in resistor $R_{Ref}$ is also referred to as the reference current $I_{Ref}$.

The second circuit branch of current source 100 includes a PMOS transistor M1 and an NMOS transistor M2 configured as an inverting amplifier. Specifically, the gate terminals of transistors M1 and M2 are connected together and to node 110. Thus, voltage $V_{top}$ is the input voltage to the inverter. The output voltage INV_OUT of the inverter is provided at the drain terminals of transistors M1 and M2 (node 112). PMOS transistor M1 and NMOS transistor M2 are not nominally sized. In the present embodiment, PMOS transistor M1 has a width to length ratio of 160:1 while NMOS transistor M2 has a width to length ratio of 10:1. Thus, when carrier mobility is taken into consideration, PMOS transistor M1 is at least eight times as strong as NMOS transistor M2. Thus, the threshold voltage of the inverter of transistors M1 and M2 is higher than the threshold voltage of a nominally sized inverter pair.

Output voltage INV_OUT of transistors M1 and M2 drives the third circuit branch of current source 100 which, in the present embodiment, includes a PMOS transistor M5 functioning as a shunt regulator. In operation, transistor M5 is biased by voltage INV_OUT so as to divert sufficient current from current source I1 to keep voltage $V_{Reg}$ regulated at the desired voltage level.

In the present embodiment, regulation of voltage $V_{Reg}$ is provided by a shunt regulator in the form of a PMOS transistor M5. However, the use of transistor M5 as a shunt regulator is illustrative only and in other embodiments, other means for regulating voltage $V_{Reg}$ using the INV_OUT signal from the second circuit branch can be used. For instance, transistor M5 can be replaced by an operational amplifier or a vertical PNP bipolar transistor.

The "sunk" output current Iout of current source 100 is provided at output terminal 114. In the present illustration, a resistor Rload is connected from Vdd to the output terminal to represent a resistive load driven by current source 100. Output current Iout is generated by serially connected NMOS transistors M6 and M7 whose current is defined by a current mirror formed by transistor M4 and transistor M6. For reasonable values of Rload, defined as values of Rload such that the voltage at the output drain terminal of transistor M7 (node 114) is within the voltage compliance range of the current source, the output current Iout is independent of the value of Rload. Transistors M4 and M6 can be equally sized devices or may have another fixed size ratio. Because they have equal gate-to-source ($V_{GS}$) voltages, the nearly PTAT current (current $I_{Ref}$) flowing in transistor M4 is mirrored to transistor M6 to provide an output current having constant temperature coefficient. NMOS transistor M7, formed as a cascode output buffer device, is connected between output terminal 114 of the current source and the drain terminal of transistor M6. Cascode transistor M7 is biased by the regulated voltage $V_{Reg}$ and functions to increase the output impedance of current source 100 and further decrease the supply voltage dependence of output current Iout. Specifically, transistor M7 isolates the drain voltage at transistor M6 from any change in the Vdd voltage. In this manner, the output current generated by current source 100 remains independent of variation in the supply voltage Vdd.

Constant Temperature Coefficient Current Generation Using MOS Transistors

Current source 100 of the present invention generates a constant temperature coefficient current using only MOS transistors and a resistor. MOS transistors can be used to generate a voltage with linear temperature dependence by biasing the MOS transistors in the subthreshold region. Specifically, when MOS devices are operated at low current density levels and are thus biased in the subthreshold or weak inversion region, the I-V characteristics of the MOS transistor are exponential and exhibit strong temperature dependence. On the contrary, when the MOS devices are operated at reasonably high current density (strong inversion region), the MOS devices operate in the square law region and the I-V characteristics are much less temperature dependent.

When a MOS device is operated at low current density, the device operation is dominated by minority carriers in the channel and the minority carrier behavior is equivalent to that of bipolar transistors. Thus, by operating a MOS device at near subthreshold, which is a point where the carrier behavior changes from square law to bipolar operation, the MOS device can be used to generate a voltage with temperature dependent characteristics. In the case of bipolar transistors, the $\Delta V_{BE}$ voltage of two bipolar transistors having a fixed current density ratio is virtually perfectly proportional to temperature. When two MOS devices operating at subthreshold region with low current density are used, the gate to source voltages ($V_{GS}$) of the MOS transistors are dominated by minority carrier action and exhibits bipolar-like operation. Thus, the difference between two $V_{GS}$ voltages of two MOS transistors having a fixed current ratio will also be perfectly proportional to temperature. The current source of the present invention exploits the subthreshold operation of MOS transistors to obtain voltage behavior that approaches the temperature dependent quality of the $\Delta V_{BE}$ voltage of bipolar transistors.

In current source 100 of the present invention, the voltage difference between the common gate voltage of the diode-connected pair (transistors M3 and M4) and the threshold voltage of the inverter pair (transistors M1 and M2) are impressed across resistor $R_{Ref}$ to generate a current nearly proportional to absolute temperature. The primary source of error in the resulting PTAT current is the temperature coefficient of resistor $R_{Ref}$. In the present embodiment, resistor $R_{Ref}$ is formed as a polysilicon resistor. A polysilicon resistor typically exhibits a constant temperature coefficient of +636 ppm/°C. The positive temperature coefficient of the resistance of the resistor reduces the amount of change in current caused by the PTAT voltage. As a result, the temperature coefficient at the current output of the current source is less than fully proportional to temperature. For instance, the output current can change by about 76% as much as a fully PTAT current source would. Because the reference current $I_{Ref}$ is inversely proportional to the resistance of resistor $R_{Ref}$, the positive temperature coefficient of the resistance results in a small amount of hyperbolic nonlinearity (less than 2%) in the reference current which nonlinearity also appears in the output current of the current source.

In other embodiments, a metal resistor, such as a nichrome resistor, of low temperature coefficient or other composite resistor of low temperature coefficient can be used in order to allow the output current of the current source to have a linear temperature coefficient closer to 100% PTAT.

Operational Principles

The behavior of various node voltages and currents within current source 100 after it settles to steady state operation is mathematically described by the equations below. The equations assume that the four MOS transistors M1 through M4 operate in the weak inversion region. The reference entitled "CMOS analog integrated circuits based on weak inversion operation," by E. Vittoz and L. Fellrath, *IEEE J. Solid-State Circuits,* vol. SC-12, pp. 662–673, December 1977, provides a description of MOS transistors operating in the weak inversion region. Specifically, the reference models the drain current of a MOS transistor as follows:

$$I_D = SI_{D0}e^{V_G/nV_t}(e^{-(V_S/V_t)} - e^{-(-V_D/V_t)}), \quad \text{Equation (1)}$$

where

- S=W/L=size factor=effective width/effective length of the transistor;
- $I_{D0}=I_{Dn0}$ for NMOS, $I_{D0}=I_{Dp0}$ for PMOS
- $I_{Dn0}$=NMOS characteristic current;
- $I_{Dp0}$=PMOS characteristic current;
- $V_G, V_S, V_D$=gate, source, and drain voltages compared to the substrate voltage;
- $V_t$=kT/q=device thermal voltage;
- k=Boltzmann's constant;
- T=absolute temperature in Kelvin;
- q=charge of an electron; and
- n=slope factor (here assumed equal for NMOS and PMOS).

When the substrate is connected to the source and when the transistor is biased with enough drain-source voltage to be fully in saturation (i.e. $V_S=0$ and $V_D-V_S \geqq 4V_t$), Equation (1) reduces to Equation (2) as follows:

$$I_D = SI_{D0}e^{V_G/nV_t}. \quad \text{Equation (2)}$$

Applying Equation (2) at transistor M1, the drain current $I_1$ of transistor M1 can be defined by:

$$I_1 = I_{left} = S_1 I_{Dp0}\exp\left(\frac{V_{reg} - V_{top}}{nV_t}\right). \quad \text{Equation (3)}$$

Similarly the drain current $I_2$ at transistor M2 is given by:

$$I_2 = I_{left} = S_2 I_{Dn0}\exp\left(\frac{V_{top}}{nV_t}\right). \quad \text{Equation (4)}$$

Because the same current (current $I_{left}$) flows through both transistors M1 and M2, Equations (3) and (4) above can be equated to solve for voltage $V_{Reg}$ as follows:

$$V_{Reg} = 2V_{top} - nV_t\ln\left(\frac{S_1 I_{Dp0}}{S_2 I_{Dn0}}\right). \quad \text{Equation (5)}$$

At the first circuit branch, Equation (2) can be applied to transistors M3 and M4 to define the respective drain currents. Then, because the same current (current $I_{right}$) flows through transistors M3 and M4, the drain current equations can be equated to solve for voltage $V_{Reg}$. Voltage $V_{Reg}$ can thus be given as:

$$V_{Reg} = 2V_{bot} - nV_t\ln\left(\frac{S_3 I_{Dp0}}{S_4 I_{Dn0}}\right). \quad \text{Equation (6)}$$

Because voltage $V_{Reg}$ is common at both circuit branches, Equations (5) and (6) can be equated to solve for reference voltage $V_{Ref}$ and reference current $I_{Ref}$ at resistor $R_{Ref}$ as follows:

$$V_{ref} = V_{top} - V_{bot} = \frac{nV_t}{2}\ln\left(\frac{S_1 S_4}{S_2 S_3}\right); \text{ and} \quad \text{Equation (7)}$$

$$I_{ref} = \frac{V_{top} - V_{bot}}{R_{ref}} = \frac{nV_t}{2R_{ref}}\ln\left(\frac{S_1 S_4}{S_2 S_3}\right). \quad \text{Equation (8)}$$

It can be seen from the above expressions for voltage $V_{Ref}$ that the reference voltage is linearly proportional to the thermal voltage $V_t$ as long as the process slope factor n does not change significantly with temperature. Note that the thermal voltage $V_t$ changes in direct proportion to absolute temperature. Similarly, the current $I_{Ref}$ is linearly proportional to $V_t$ if the slope factor n and the resistance of $R_{Ref}$ is constant with temperature.

The circuit topology also constrains the current through the inverter pair (current $I_{left}$) to be a constant ratio of the current through the diode-connected pair (current $I_{right}$ which is equal to current $I_{Ref}$) which ratio is dependent only upon the relative sizing of the transistors. This circuit topology constraint can be shown mathematically by applying the equation for drain current (Equation (2)) at NMOS transistors M2 and M4 and using Equation (9) below:

$$V_{top} = V_{bot} + I_{Ref}R_{Ref}. \quad \text{Equation (9)}$$

Accordingly:

$$I_{ref} = I_{right} = S_4 I_{Dn0}\exp\left(\frac{V_{bot}}{nV_t}\right), \text{ and} \quad \text{Equation (10)}$$

$$I_{left} = S_2 I_{Dn0}\exp\left(\frac{V_{top}}{nV_t}\right)$$

$$I_{left} = S_2 I_{Dn0}\exp\left(\frac{V_{bot}}{nV_t}\right)\exp\left(\frac{I_{ref}R_{ref}}{nV_t}\right). \quad \text{Equation (11)}$$

Defining the ratio of currents $I_{left}/I_{Ref}$:

$$\frac{I_{left}}{I_{ref}} = \frac{S_2}{S_4}\exp\left(\frac{I_{ref}R_{ref}}{nV_t}\right). \quad \text{Equation (12)}$$

Substituting equation (8) for $I_{Ref}$ and collecting terms the ratio of currents $I_{left}/I_{Ref}$ is given by:

$$\frac{I_{left}}{I_{ref}} = \left(\frac{S_1 S_2}{S_3 S_4}\right)^{1/2}. \quad \text{Equation (13)}$$

Thus, the current $I_{left}$ follows the temperature dependence of current $I_{Ref}$ exactly and has an amplitude which is a constant fraction of the amplitude of current $I_{Ref}$ which fraction is dictated by the relative size factors of the transistors.

Referring to FIG. 1, transistors M1 and M2 are connected as an inverting pair and are used as a self-referencing inverting linear amplifier. The self referential operation above refers to the inverter threshold voltage, and is given by that voltage at the inverter input which causes the same voltage at the inverter output. Applied input voltages above the inverter threshold voltage force the inverter output to a voltage less than the threshold voltage, and applied input voltages below the threshold voltage force the inverter output to a voltage above the threshold voltage.

In steady state weak inversion operation the relative size of transistors M1 and M2 defines the threshold voltage. Referring to FIG. 1, $V_{top}$ is given by:

$$V_{top} = \frac{V_{reg}}{2} + \frac{nV_t}{2}\ln\left(\frac{S_1 I_{Dp0}}{S_2 I_{Dn0}}\right), \quad \text{Equation (14)}$$

where $I_{Dn0}$ and $I_{Dp0}$ are the process dependent characteristic currents of PMOS and NMOS devices and n is assumed equal for NMOS and PMOS. If the ratio inside the natural logarithm is greater than one, then voltage $V_{top}$ is a voltage greater than voltage $V_{Reg}/2$. As the temperature increases, the thermal voltage $V_t$ increases, and voltage $V_{top}$ becomes larger with respect to voltage $V_{Reg}$.

Similarly, in steady state operation, when the operating current is set low enough that the devices M1 through M4 operate in the weak inversion region, diode connected transistors M3 and M4 define a voltage $V_{bot}$ which is set by the relative size of transistors M3 and M4. Specifically:

$$V_{bot} = \frac{V_{reg}}{2} - \frac{nV_t}{2}\ln\left(\frac{S_4 I_{Dn0}}{S_3 I_{Dp0}}\right). \quad \text{Equation (15)}$$

If the ratio inside the natural logarithm is more than one, then $V_{bot}$ is a voltage below $V_{Reg}/2$. It can also be seen that as the thermal voltage $V_t$ increases with temperature, the voltage at $V_{bot}$ becomes smaller with respect to $V_{Reg}$.

By sizing transistors M1 through M4 appropriately, voltage $V_{top}$ can thus be made larger than voltage $V_{bot}$. Both voltage $V_{top}$ and voltage $V_{bot}$ change with temperature due to the presence of the thermal voltage term, $V_t$, in the equations above. The voltage difference between voltage $V_{top}$ and voltage $V_{bot}$ can then be used as a temperature dependent reference voltage. When this voltage difference is impressed across a resistor, a constant temperature coefficient reference current can be generated.

Regulation Operation

The generation of a constant temperature coefficient current by current source 100 while exhibiting a high power supply rejection ratio (PSRR) is described below.

When the circuit of 100 is powered up, it is assumed here that the current source I1 increases from zero current to some fixed current value. After the current reaches its fixed value, and after transients generated by the startup transition have decayed, the various circuit nodes will be at their steady state closed loop operating points.

The fixed current I1 is supplied to the $V_{Reg}$ node 106. From node 106 the current will divide through three possible circuit paths to flow to ground. The first circuit path is through transistors M3 and M4. The second path is through transistors M1 and M2. The third path is through transistor M5.

In steady state operation transistors M3 and M4 establish a voltage $V_{bot}$ at node 108 according to Equation (15). Also, transistors M1 and M2 establish a voltage $V_{top}$ at node 110 according to Equation (14). This voltage $V_{top}$ is the threshold voltage of the inverting amplifier formed by transistors M1 and M2. In steady state operation the voltage difference between voltages $V_{top}$ and $V_{bot}$ is impressed across resistor $R_{Ref}$, which causes a reference current $I_{Ref}$ to flow through transistors M3 and M4 in the first circuit path.

The steady state ratio of currents between the second circuit branch (transistors M1–M2) and the first circuit branch (transistors M3–M4) is set by the temperature-independent relative size constraint of Equation (13). If less of the fixed current from I1 is diverted to ground through the third circuit path at shunt regulator M5, the current through both of the first two branches will increase, while remaining in relative proportion. Because the two currents in the first and second circuit branches are constrained to operate at a fixed ratio in steady state, by monitoring and servoing one current to its desired value the other will also be servoed to its desired value.

The reference current $I_{Ref}$ through transistors M3–M4 is monitored by a feedback loop which continuously sets the amount of current diverted through transistor M5 such that the desired amount of current flows both at the first circuit branch (transistors M3–M4) and at the second circuit branch (transistors M1–M2). Diverting the required amount of current is equivalent to regulating the voltage $V_{Reg}$ at node 106 to the desired voltage.

The feedback loop consists of the inverting amplifier formed by transistors M1–M2 and a transconducting shunt regulator implemented as PMOS source follower M5 in FIG. 1. The inverting amplifier, operated with both devices in the linear region and with an input voltage close to its threshold voltage, supplies a large voltage gain to the error signal. Its output is applied to a large width-to-length PMOS device (transistors M5) in order to obtain high transconductance. The purpose of the shunt regulator device M5 is to divert just enough current from current source I1 such that the correct reference current flows through resistor $R_{Ref}$. In operation current source I1 must provide sufficient current to supply the first and second circuit branches (transistors M1 to M4) plus some additional current to be diverted through shunt regulator transistor M5.

The loop gain from $V_{top}$ to the shunted current at the source terminal of M5 is given by the voltage gain of the inverter multiplied by the transconductance of transistor M5. The loop gain can be very large, which assures that the feedback loop will be very accurate and will maintain voltage $V_{Reg}$ and current $I_{Ref}$ to high accuracy even if power supply changes or other events disturb the amount of current flowing from I1.

In closed loop operation, the negative feedback loop from $V_{top}$ to voltage INV_OUT to voltage $V_{Reg}$ to voltage $V_{top}$ operates in a manner such that the voltage $V_{top}$ is servoed to a voltage very, very close to the inverter threshold voltage given by Equation (14) above. If the current I1 were to momentarily increase, and cause voltage $V_{Reg}$ to increase to a voltage $V_{Reg}+\Delta V_{Reg}$, the voltage $V_{bot}$ at node 108 would increase by $\Delta V_{Reg}/2$ and the inverter threshold voltage would also increase by $\Delta V_{Reg}/2$. However, the voltage $V_{top}$ is $I_{Ref}*R_{Ref}$ above voltage $V_{bot}$ and would increase by $\Delta V_{Reg}/2+\Delta(I_{Ref}*R_{Ref})$. Thus the difference between voltage $V_{top}$ and the inverter threshold voltage is an error signal proportional to the amount of deviation of $I_{Ref}$ from the desired value. The feedback loop seeks to minimize this error signal and would divert more current through transistor M5 until the error signal returned to nearly zero.

Figure 5:
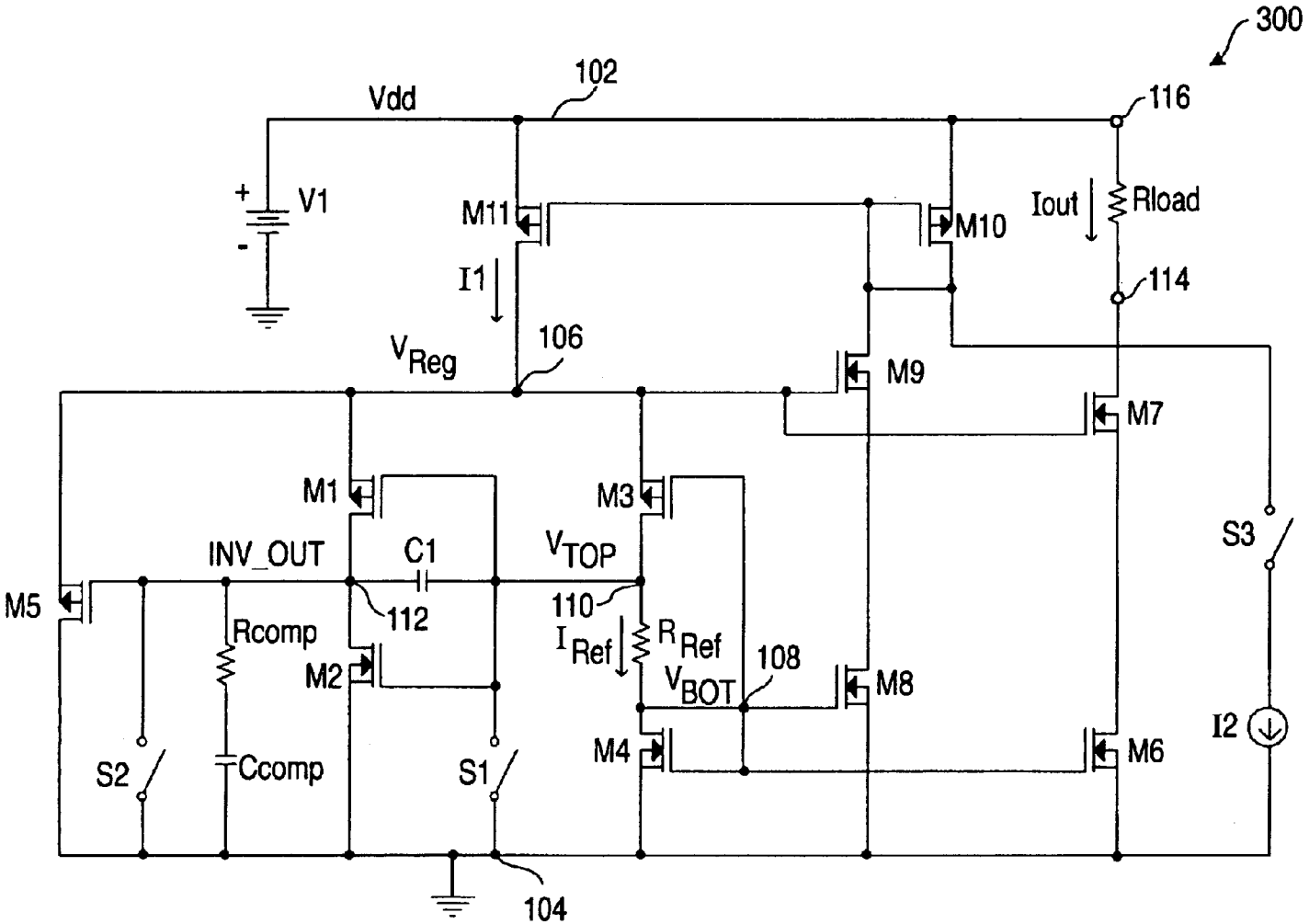
FIG. 5 is a circuit diagram of a constant temperature coefficient self-regulating current source according to a third embodiment of the present invention where the excitation current is bootstrapped from the current source itself for increased power supply rejection.

Due to the presence of the feedback control system and its shunt regulator, current source I1 does not need to be precise or to exhibit any required temperature coefficient. Current source I1 must supply only a current large enough for the temperature dependent requirements of transistors M1–M4 and a minimal amount of excess current in order to keep the bandwidth at transistors M5 at the desired level. However, high frequency disturbances beyond the bandwidth of the feedback loop will not be fully suppressed, and a finite loop gain can only reduce disturbances by an amount approximated by (1/loop gain). It is thus desirable to implement I1 in a manner which itself exhibits low wideband noise and high power supply rejection. In one embodiment, current source I1 is implemented as a bootstrapped current mirrored from the reference current itself for achieving extremely good power supply rejection and low noise. This configuration is illustrated in FIG. 5 and described in more detail below.

Operational Constraints

As described above, current source 100 generates an output current with constant temperature coefficient and near zero power supply dependency. In operation, the quiescent operating point of current source 100 is established by the following three constraints.

The first constraint concerns the generation of a temperature dependent current in the first circuit branch (transistors M3 and M4) of current source 100. By using non-nominal transistor size ratios in the first circuit branch and the second circuit branch, voltages $V_{top}$ and $V_{bot}$ are established such that voltage $V_{top}$ minus voltage $V_{bot}$ is equal to a reference voltage $V_{Ref}$. The $V_{Ref}$ voltage is impressed across resistor $R_{Ref}$ to generate the temperature dependent reference current $I_{Ref}$ in current source 100, which current flows through the diode-connected transistors M3 and M4.

Equation (7) above shows that the reference voltage $V_{Ref}$ generated across resistor $R_{Ref}$ is exactly proportional to the absolute temperature of the isothermal transistors M1 through M4. Equation (8) above shows that current $I_{Ref}$ would be exactly proportional to absolute temperature if the resistance of resistor $R_{Ref}$ could be held constant with temperature. The linear resistance temperature coefficient of +636 ppm/°C. of the polysilicon resistor used in the present embodiment decreases the amount of change with temperature such that a change that is proportional to 76% of the change of an exact PTAT current source results.

The second constraint concerns forcing the currents in the first and second circuit branches to operate at the same temperature coefficient. Equation (13) above shows that the current $I_{left}$, through transistors M1 and M2, is a constant fraction of the reference current $I_{Ref}$, through transistors M3 and M4. Moreover Equation (13) shows that the fraction can be chosen by the sizing of the transistors M1 through M4 and that the fraction is independent of temperature. Thus currents $I_{left}$ and $I_{Ref}$ exhibit exactly the same temperature coefficient.

The final constraint concerns the regulation of voltage $V_{Reg}$ to ensure that the correct temperature dependent current is generated at the first circuit branch and that this current is immune to perturbations in the power supply voltage Vdd.

By considering constraints one and two, the currents in the first and second circuit branches are known to be currents with a temperature change of 76% PTAT in the present embodiment. The amount of current flowing through the inverter (transistors M1 and M2) is known to be some size-determined fraction of the current through the diode-connected transistors M3 and M4. It is therefore possible to monitor only the reference current with a feedback loop and to simultaneously set both the current through transistors M3 and M4 and the current through transistors M1 and M2 by controlling voltage $V_{Reg}$ on node 106.

To maintain current source 100 at the desired operating point, where there is just enough current in transistors M3 and M4 to generate the $V_{Ref}$ voltage across resistor $R_{Ref}$, a control loop using transistors M1 and M2 as an error amplifier and transistor M5 as a shunt regulator is used.

In operation, there is one voltage at which transistors M1 and M2 can drive transistor M5 such that transistor M5 drains the excess current from current source I1 and the right amount of current flows through transistors M3 and M4. If voltage $V_{Reg}$ increases, perhaps due to a supply voltage increase, the current through the first circuit branch will increase and voltage $V_{top}$ will increase accordingly. When voltage $V_{top}$ increases, the inverting linear amplifier at transistors M1 and M2 will cause the output voltage INV_OUT to decrease. The drop in inverter output voltage INV_OUT causes PMOS transistor M5 to turn on and draw more current away from current source I1. As a result, voltage $V_{Reg}$ returns to the expected regulated voltage level. In effect, transistor M5 acts a shunt regulator to keep voltage $V_{Reg}$ at the desired voltage level. Transistor M5 is biased by the closed loop control system in such a way as to divert sufficient current from current source I1 to ensure that voltage $V_{Reg}$ remains regulated.

In current source 100, a large loop gain is provided to achieve the desired regulation. For instance, the full voltage gain of the inverter pair is employed. Transistor M5 is bootstrapped to voltage $V_{Reg}$ such that only a very small change in the gate-to-source voltage of the transistor is needed to cause a large change in current being drawn away. Thus, a compound gain composed of the voltage gain of the inverter multiplied by the transconductance of transistor M5 is realized which provides for a very large loop gain for the voltage regulator. A very tight voltage regulation can be realized.

Operation Summary

In summary, current source 100 includes a first circuit branch and a second circuit branch of transistors connected in an "H" configuration. Both of the circuit branches are supplied by a current source I1 powered by the supply voltage Vdd. The first circuit branch includes a pair of diode-connected transistors connected in series with a resistor $R_{Ref}$ interposed at the drain terminals. Resistor $R_{Ref}$, imposed between voltage $V_{top}$ and voltage $V_{bot}$, defines the operating current of current source 100. The second circuit branch consists of an inverter pair functioning as an error amplifier providing an "error signal" to facilitate regulation of the supply voltage. In the present embodiment, the error signal is a function of the $V_{top}$ voltage which, when increased to a certain voltage level, will cause the error amplifier to react to return $V_{top}$ to the desired operating point. The regulation is realized by a third circuit branch, which receives the "error signal" and regulates voltage $V_{Reg}$ accordingly to maintain voltage $V_{Reg}$ at the desired regulated level. In the present embodiment, the third circuit branch includes PMOS transistor M5 acting as a shunt regulator. Transistor M5 receives the "error signal" from the second circuit branch and provides regulation of the supply voltage by draining excess current from current source I1.

Voltages $V_{top}$ and $V_{bot}$ are generated by operating the transistors M1 to M4 in the subthreshold region and by setting the transistors effective strength by sizing the transistors in a non-nominal, asymmetric fashion. That is, in the first circuit branch, the PMOS transistor is made to be a lot weaker than the NMOS transistor, and in the second circuit branch, the PMOS transistor is made to be a lot stronger than the NMOS transistor. This non-nominal sizing of the transistors creates common gate voltages at the first circuit branch and inverter threshold voltages at the second circuit branch that are different from nominal voltage levels.

The operation of current source 100 can be divided into two parts. First, voltages VTOP and VBOT are established by using asymmetrical sizing of transistors in the first circuit branch and the second circuit branch. The difference of voltages $V_{top}$ and $V_{bot}$ defines the $V_{Ref}$ voltage which is imposed across resistor $R_{Ref}$ for defining a current in the first circuit branch. Furthermore, the transistors in the first and second circuit branches are operated in the subthreshold region so that the $V_{Ref}$ voltage exhibits temperature dependent behavior. In this manner, the first circuit branch yields a nearly PTAT current which can be used as the basis for the output current for current source 100. In the present embodiment, the output current is a 76% PTAT current because of the use of a polysilicon resistor for resistor $R_{Ref}$.

Second, the second circuit branch in conjunction with the third circuit branch provides regulation of the regulated voltage $V_{Reg}$ to ensure that the nearly PTAT current generated by the first circuit branch is isolated from variations in the power supply voltage Vdd. Specifically, the inverter pair of the second circuit branch detects whether the current source has reached the ideal operating point and provides an "error signal" to adjust the effective current flowing in the first circuit branch so as to keep the circuit at the ideal operating point. When current source 100 has reached equilibrium, voltage INV_OUT will be near the midpoint between voltage $V_{Reg}$ and ground. When the current flowing in the first circuit branch becomes too high, voltage INV_OUT will decrease to allow the third circuit branch to drain off the excess current, thereby regulating voltage $V_{Reg}$. Thus, the current though the first circuit branch can remain stable despite variations in the supply voltage.

Current source 100 will operate to define an "ideal" voltage difference $V_{Ref}$ between voltage $V_{top}$ and voltage $V_{bot}$ and resistor $R_{Ref}$ defines the nearly ideal current $V_{Ref}/R_{Ref}$. The regulation provided by the second circuit branch and the third circuit branch is applied to keep the operating point of the circuit as close as possible to the ideal current condition.

The voltage difference between voltage $V_{top}$ and voltage $V_{bot}$ can be made as large as desired and in one embodiment, the voltage difference is 60 to 100 mV.

Operational Characteristics and Advantages

Figure 2:
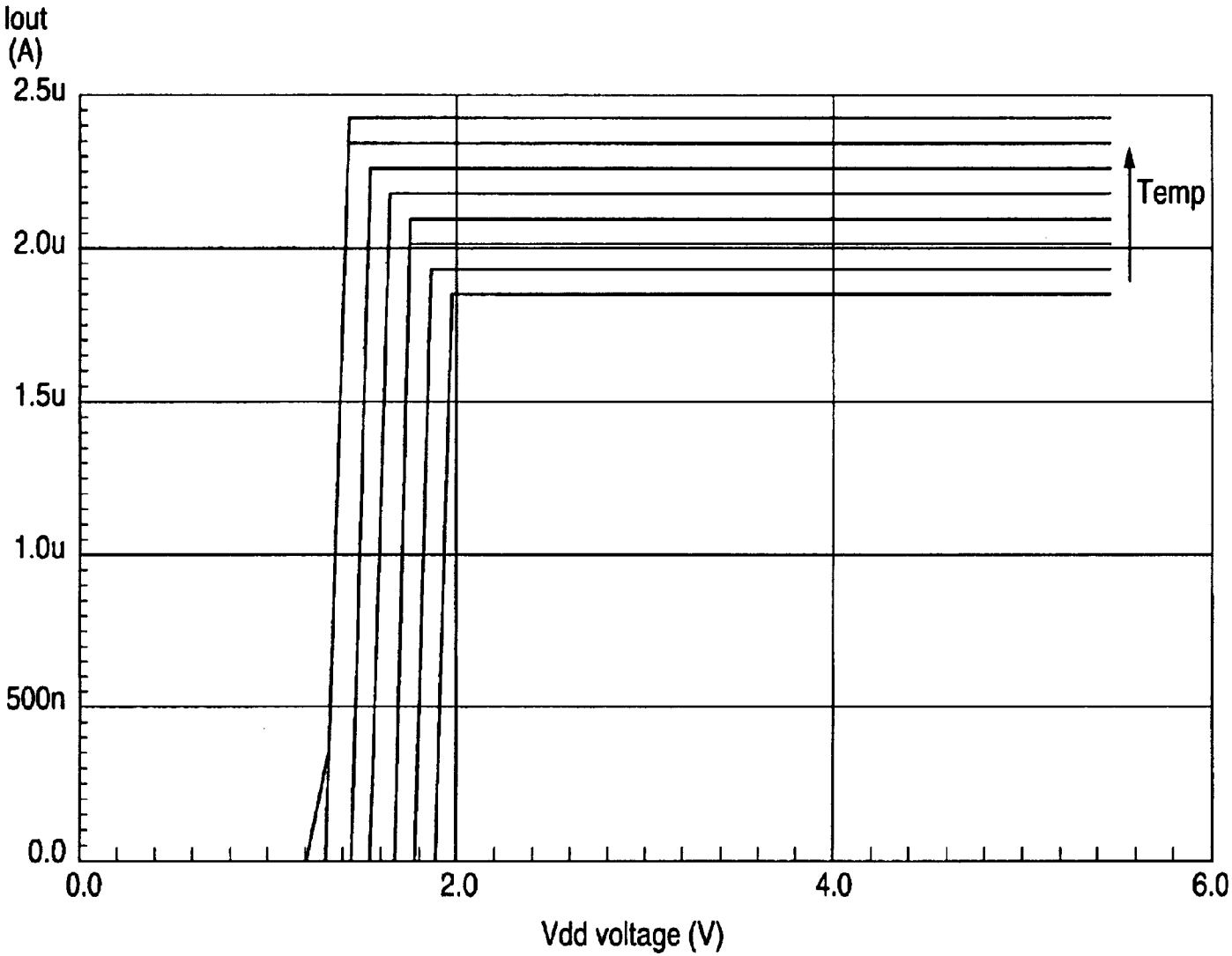
FIG. 2 is a plot of output current versus Vdd voltage illustrating the output current characteristics for the current source in FIG. 1 over a range of Vdd voltage and temperature values.
Figure 3:
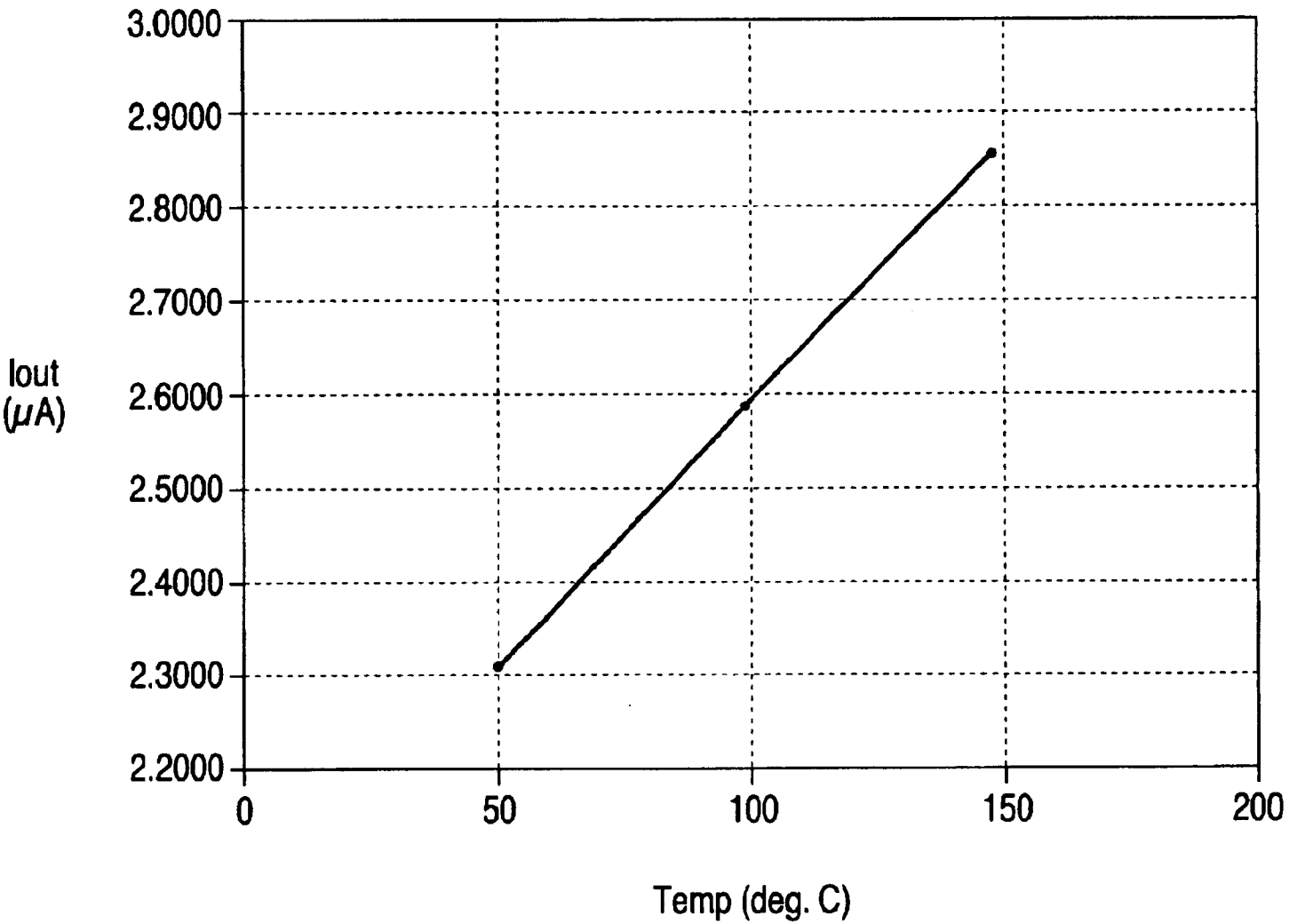
FIG. 3 is a plot of the output current versus temperature illustrating the linear temperature dependent characteristics of the current source of the present invention.

FIG. 2 is a plot of output current Iout versus Vdd voltage illustrating the output current characteristics for current source 100 over a range of temperature values. As shown in FIG. 2, after sufficient Vdd voltage is applied to power up the circuit (about 2 volts), output current Iout of current source 100 is constant over Vdd voltages from 2 volts to 5 volts. Furthermore, the output current increases linearly with temperature as illustrated by the stepwise increase of each curve representing increasing temperature. The constant temperature coefficient of output current Iout is also illustrated in FIG. 3 which is a plot of the output current versus temperature. In the present illustration, current source 100 exhibits a linear increase in current with temperature from 50° C. to 150° C.

Besides being capable of generating a nearly PTAT current with high PSRR, the current source of the present invention realizes other advantages. For instance, because the current source of the present invention does not rely on bipolar transistors to generate a $\Delta V_{BE}$ voltage, the current source can be implemented entirely using CMOS transistors. Thus, the current source can be manufactured using CMOS processes and does not require complex BiCMOS fabrication processes. Furthermore, the current source of the present invention can be implemented using minimal silicon area, thereby reducing manufacturing cost.

Alternate Embodiments

In another embodiment, current source 100 may include components for providing AC compensation to ensure stability at high frequency. In the present embodiment, current source 100 includes a capacitor C1 coupled between node 110 (voltage VTOP) and node 112 (voltage INV_OUT) to filter out noise at the output terminal of the inverter pair. In the present embodiment, current source 100 further includes a capacitor Ccomp and resistor Rcomp connected in series for providing pole and zero compensation for frequency stability. Capacitor Ccomp rolls off at high frequency and resistor Rcomp provides a zero which allows for limited stable high frequency operation. In the present embodiment, capacitor C1 has a capacitance value of 0.1 pF, capacitor Ccomp has a capacitance value of 1.6 pf, and resistor Rcomp has a resistance value of 50 kΩ.

According to yet another embodiment, current source 100 may include switches for facilitating power up and reset operations. Referring to FIG. 1, in the present embodiment, current source 100 includes a switch S1 coupled between node 110 and the ground node 104 and a switch S2 coupled between node 112 and the ground node 104. In operation, switches S1 and S2 are closed temporarily during power up to discharge capacitors C1 and Ccomp and to ensure that the current source will start from a defined state after the switches are opened. Switches S1 and S2 may also be closed during a reset operation. In this manner, capacitors C1 and Ccomp are discharged and current source 100 is ensured to be able to start up.

Figure 4:
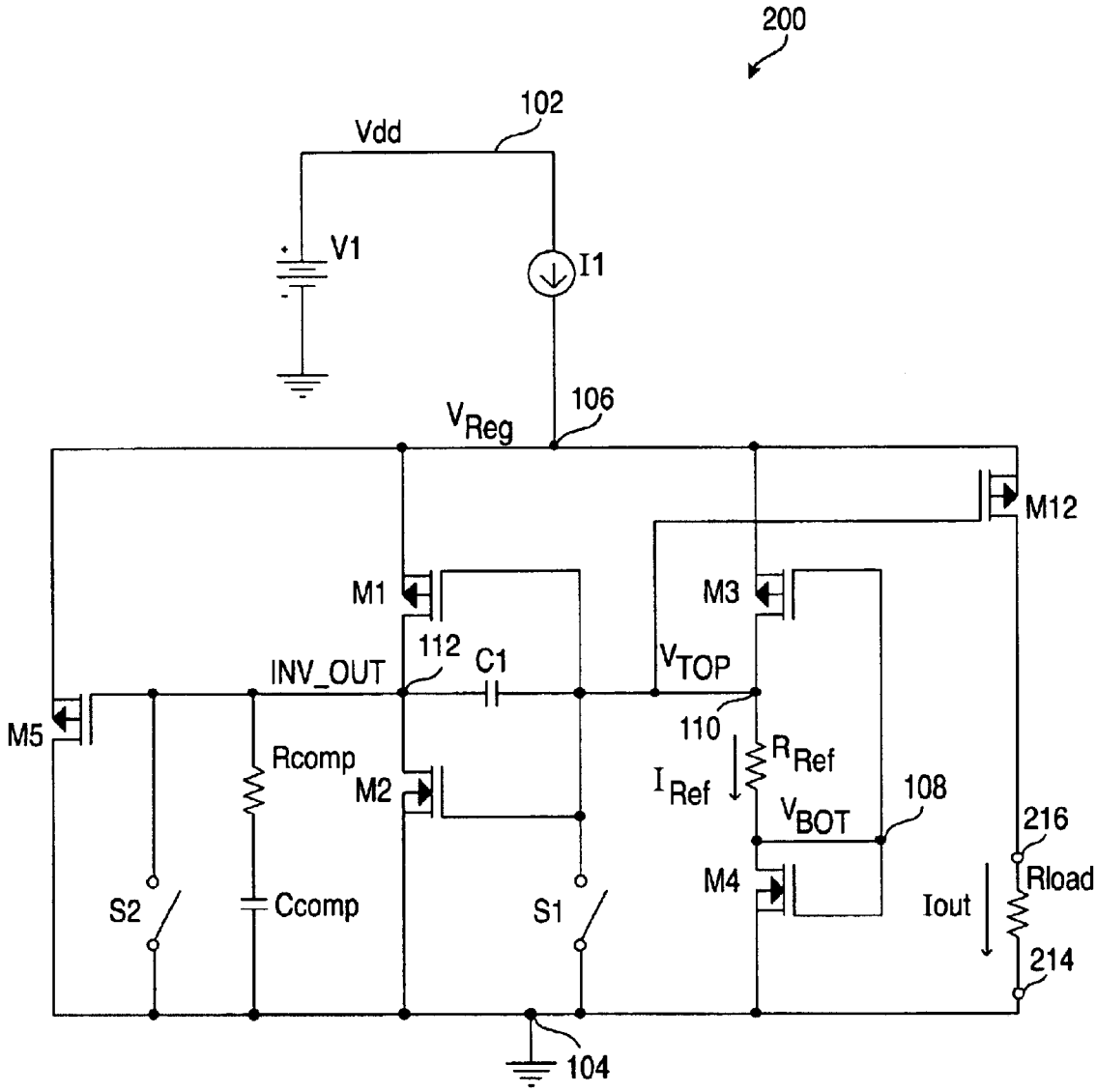
FIG. 4 is a circuit diagram of a constant temperature coefficient self-regulating current source according to a second embodiment of the present invention.

In the embodiment shown in FIG. 1, the output current Iout is sunk by transistors M6 and M7 through the use of a current mirror at transistors M4 and M6. In other embodiments, the output current of the current source can be sourced from the regulator voltage node as shown in FIG. 4. FIG. 4 is a circuit diagram of a constant temperature coefficient self-regulating current source according to a second embodiment of the present invention. Like elements in FIGS. 1 and 4 are given like reference numerals to simplify the discussion.

Referring to FIG. 4, current source 200 provides an output current Iout that is sourced from voltage $V_{Reg}$ (node 106). Specifically, the output current Iout is generated by a PMOS transistor M12. The source terminal of transistor M12 is connected to voltage $V_{Reg}$ and the drain terminal is connected to the output terminal 216. The gate terminal of transistor M12 is driven by the voltage $V_{top}$ at node 110. The sourced output current Iout is available at the drain terminal of transistor M12. In operation, voltage $V_{top}$ is forced to a value which will provide the proper current through transistor M1. If transistor M12 is sized the same as transistor M1, then a current identical to that flowing through transistor M1 will be sourced from the PMOS output device transistor M12 into a reasonable value of output load resistance Rload to ground. Intentionally sizing transistor M12 greater or larger than transistor M1 can be used to select output currents proportionally greater or larger than the current chosen to flow through transistor M1. In this embodiment, the sourced output current Iout must be provided by current source I1, which also supplies the operating current to the circuit. The amount of current supplied by current I1 may need to be increased when the PMOS current output device is used in order to maintain enough current for both the external load and for proper loop operation.

In the embodiment shown in FIG. 1, current source I1 is a stand-alone current source providing a fixed current value. In other embodiments, current source I1 can be implemented as a current source having its current magnitude derived in a bootstrapped manner from the constant temperature coefficient reference current source itself which has the advantage of increased power supply rejection. FIG. 5 is a circuit diagram of a constant temperature coefficient self-regulating current source according to a third embodiment of the present invention. Like elements in FIGS. 1 and 5 are given like reference numerals to simplify the discussion.

Referring to FIG. 5, current source 300 is configured such that the excitation current I1 for the circuit is bootstrapped from the current source itself. Specifically, the excitation current I1 is derived from the constant temperature coefficient reference current $I_{Ref}$ generated at resistor $R_{Ref}$ of current source circuit. In current source 300, current source I1 is implemented as a PMOS current mirror (transistors M10 and M11) whose amplitude is derived from a replica of the constant temperature coefficient reference current $I_{Ref}$. As shown in FIG. 5, current source 300 includes NMOS transistor M6 for mirroring a first replica of reference current $I_{Ref}$ to provide as the output current Iout. Current source 300 further includes a NMOS transistor M8. The gate to source voltage of transistor M8 is equal to that of transistor M4. Therefore, the drain current of transistor M8 will also mirror that of transistor M4. Thus a second replica of reference current $I_{Ref}$ is caused to flow through transistor MB. This second replica reference current is used to excite the PMOS mirror at transistors M10 and M11 and thus to generate the excitation current I1. An NMOS transistor M9 is coupled to transistor M8 as a cascode device to buffer the drain terminal of transistor M8 from voltage variations in the supply voltage Vdd. Specifically, transistor M9 is connected in the same manner as transistor M7 and has its gate terminal connected to the regulated voltage node 106.

The current flowing through transistor M9 is applied to the current mirror formed by transistors M10 and M11. PMOS transistor M10 is diode-connected and has its source terminal connected to the positive supply voltage Vdd (node 102). The drain and gate terminals of transistor M10 are applied to the gate terminal of PMOS transistor M11 in a manner to mirror the current through transistor M10 at transistor M11. The relative sizes of transistors M10 and M11 are adjusted to obtain the desired magnitude of current at the drain terminal of transistor M11 which current is coupled to the regulated voltage node 106 for supplying current to the circuit branches of current source 300. In particular, the current mirror of transistors M10 and M11 can implement a ratioed gain to generate current I1 having sufficient magnitude to supply current source 300. For example, if the reference current through $R_{Ref}$ is 2 uA, and transistor M8 was sized identically to transistor M4, then the current through transistor M10 will also be 2 uA. If 20 uA is the desired output current I1 at transistor M11, then transistor M11 can be sized ten times wider than transistor M10 while using the same length. In this manner, current I1 is a multiple of the reference current and is guaranteed to be in excess of the current needed to supply transistors M1 and M3 which excess current is diverted by the shunt regulator (transistor M5).

At initial power-up of current source 300, switches S1 through S3 are closed. Switches S1 and S2 are used to set known startup voltages for the bootstrapped loop and to dissipate any charge which might have been held in capacitors C1 and Ccomp at their respective nodes. The current source I2, switchably connected through switch S3, is used to apply a small, known startup current to the PMOS current mirror transistors M10 and M11 to insure that the PMOS current mirror turns on. Current source I2 can be generated by a resistor to ground or by other means. After the supply voltage V1 has been applied, switches S1 through S3 are opened, and the current source circuit bootstraps itself to its proper operating point.

In an alternate embodiment of current source 300, a small resistor can be connected between the source terminal of transistor M8 and the ground potential (node 104) while the substrate connection of transistor M8 remains connected directly to ground. It is known that the operation of the bootstrapped current source implementation of current I1 through transistors M8 to M11 uses positive feedback. This feedback can detract from the dynamic recovery performance of the negative feedback loop through transistor M5 used to regulate the reference current during steady state operation. However, this positive feedback is useful at powerup to speedily push the circuit to its desired steady state operating points. The resistor degenerated connection of transistor M8 supplies larger positive feedback at powerup, insuring speedy settling to steady state, but the amount of positive feedback is reduced once appreciable current starts to flow through transistor M8, such as at steady state.

The above detailed descriptions are provided to illustrate specific embodiments of the present invention and are not intended to be limiting. Numerous modifications and variations within the scope of the present invention are possible. For example, cascode transistor M7 is included to provide additional isolation against power supply variations and to increase output impedance. In other embodiments, other buffering devices may be used in place of transistor M7 or the output current can be taken directly from the drain terminal of transistor M6. The present invention is defined by the appended claims.

We claim:

1. A current source, comprising:

a voltage source providing a first supply voltage;

a first current source coupled to the first supply voltage and providing a first current to a first node;

a first circuit branch comprising a first transistor being diode-connected, a resistor and a second transistor being diode-connected, all connected in series between the first node and a ground node, the first transistor being diode-connected through the resistor;

a second circuit branch comprising an inverter including a third transistor and a fourth transistor connected in series between the first node and the ground node, the inverter receiving a first voltage as an input voltage and generating an output voltage; and a third circuit branch comprising a shunt regulator coupled between the first node and the ground node and controlled by the output voltage of the second circuit branch, the shunt regulator being operated to regulate a voltage at the first node in response to the output voltage, wherein the first, second, third and fourth transistors are biased in the subthreshold region, and the transistors in each of the first and second circuit branches have non-nominal transistor size ratios such that the first voltage is established at a first terminal of the resistor and a second voltage is established at a second terminal of the resistor and a voltage across the resistor is a voltage proportional to absolute temperature.

2. The current source of claim 1, wherein the first and third transistors are of a first conductivity type and the second and fourth transistors are of a second conductivity type, and wherein the second transistor has a width/length ratio larger than one half a width/length ratio of the first transistor, and the third transistor has a width/length ratio more than two times larger than a width/length ratio of the fourth transistor.

3. The current source of claim 2, wherein the second transistor is at least two times the size of the first transistor, and the third transistor is at least ten times the size of the fourth transistor.

4. The current source of claim 2, wherein the size ratio of the first and second transistors establishes a common gate voltage as the second voltage wherein the second voltage has a value that is lower than the common gate voltage of a pair of nominally sized transistors, and wherein the size ratio of the third and fourth transistors establishes a threshold voltage as the first voltage wherein the first voltage has a value that is higher than the threshold voltage of a nominally sized inverter, such that the voltage difference between the first voltage and the second voltage is the voltage proportional to absolute temperature and the voltage difference is applied across the resistor to generate a current nearly proportional to absolute temperature.

5. The current source of claim 1, wherein the first transistor is of a first conductivity type and comprises a source terminal coupled to the first node, a drain terminal coupled to a second node and a gate terminal coupled to a third node, the resistor being coupled between the second node and the third node, and wherein the second transistor is of a second conductivity type and comprises a source terminal coupled to the ground node, and a drain terminal and a gate terminal coupled to the third node, and the first voltage is provided at the second node and the second voltage is provided at the third node.

6. The current source of claim 1, further comprising:

a fifth transistor having a drain terminal coupled to an output node, a source terminal coupled to the ground node and a gate terminal coupled to a gate terminal of the second transistor, the fifth transistor and the second transistor forming a current mirror, wherein the fifth transistor provides an output current at the output node that is derived from a current flowing in the resistor generated by the voltage proportional to absolute temperature.

7. The current source of claim 6, further comprising:

a sixth transistor having a drain terminal coupled to the output node, a source terminal coupled to the drain terminal of the fifth transistor, and a gate terminal coupled to the first node, wherein the sixth transistor provides the output current at the output node based on the current flowing in the fifth transistor.

8. The current source of claim 1, further comprising:

a fifth transistor having a drain terminal coupled to an output node, a source terminal coupled to the first node and a gate terminal coupled to receive the first voltage, wherein the fifth transistor provides an output current at the output node that is derived from a current flowing in the resistor generated by the voltage proportional to absolute temperature.

9. The current source of claim 1, wherein the shunt regulator regulates the voltage at the first node by drawing a portion of the first current from the first current source in response to the output voltage generated by the second circuit branch.

10. The current source of claim 2, wherein the shunt regulator comprises a fifth transistor of the first conductivity type and having a source terminal coupled to the first node, a drain terminal coupled to the ground node and a gate terminal coupled to receive the output voltage of the second circuit branch.

11. The current source of claim 10, wherein the third transistor is of the first conductivity type and comprises a source terminal coupled to the first node, a drain terminal coupled to a fourth node providing the output voltage and a gate terminal coupled to the second node, and wherein the fourth transistor is of the second conductivity type and comprises a source terminal coupled to the ground node, a drain terminal coupled to the fourth node and a gate terminal coupled to the second node.

12. The current source of claim 11, wherein the first, second, third, fourth and fifth transistors are MOS transistors, the first conductivity type is P-type and the second conductivity type is N-type.

13. The current source of claim 11, further comprising:

a first capacitor coupled between the second node and the fourth node; and a second resistor and a second capacitor connected in series between the fourth node and the ground node.

14. The current source of claim 13, further comprising:

a first switch coupled between the second node and the ground node; and a second switch coupled between the fourth node and the ground node, wherein the first switch and the second switch are closed during reset operations to discharge the first and second capacitors.

15. The current source of claim 1, further comprising an output device for generating an output current at an output node, the output current being derived from a current flowing in the resistor generated by the voltage proportional to absolute temperature, wherein the first current source generates the first current that is derived from and proportional to the current flowing in the resistor.

16. The current source of claim 7, wherein the first current source comprises a current mirror generating the first current by mirroring a current proportional to the current flowing in the resistor.

17. The current source of claim 16, wherein said first current source comprises:

a seventh transistor having a drain terminal coupled to a second node, a source terminal coupled to the ground node and a gate terminal coupled to the gate terminal of the second transistor, the seventh transistor and the second transistor forming a current mirror;

an eighth transistor having a drain terminal coupled to a third node, a source terminal coupled to the second node, and a gate terminal coupled to the first node, a ninth transistor having a drain terminal and a gate terminal coupled to the third node, a source terminal coupled to the first supply voltage;

a tenth transistor having a drain terminal coupled to the first node, a source terminal coupled to the first supply voltage, and a gate terminal coupled to the gate terminal of the ninth transistor, wherein the seventh and eighth transistors operate to provide a second current at the third node that is derived from the current flowing in the resistor generated by the voltage proportional to absolute temperature; and wherein the ninth and tenth transistors form the current mirror for supplying a current proportional to the second current to the first node.

18. The current source of claim 17, wherein the source terminal of the seventh transistor is coupled to the ground node through a second resistor, and a substrate connection of the seventh transistor is coupled to the ground node directly.

19. The current source of claim 1, wherein the resistor comprises a polysilicon resistor.

20. The current source of claim 1, wherein the resistor comprises a metal resistor of low temperature coefficient.

21. A current source for generating an output current, comprising:

a voltage source providing a first supply voltage;

a first current source coupled to the first supply voltage and providing a first current to a first node;

a first transistor having a source terminal coupled to the first node, a drain terminal coupled to a second node and a gate terminal coupled to a third node;

a resistor coupled between the second node and the third node;

a second transistor having a source terminal coupled to a ground node, a drain terminal and a gate terminal both coupled to the third node;

a third transistor having a source terminal coupled to the first node, a drain terminal coupled to a fourth node, and a gate terminal coupled to the second node;

a fourth transistor having a source terminal coupled to the ground node, a drain terminal coupled to the fourth node, and a gate terminal coupled to the second node; and a shunt regulator coupled to receive an input voltage at the fourth node and regulating a voltage at the first node in response to the input voltage;

wherein the first, second, third and fourth transistors are biased in the subthreshold region, the first and second transistors have non-nominal transistor size ratio while the third and fourth transistors have non-nominal transistor size ratio such that a first voltage is established at the second node and a second voltage is established at the third node, and a voltage difference between the first voltage and the second voltage is a voltage proportional to absolute temperature.

22. The current source of claim 21, wherein the first and third transistors comprise PMOS transistors and the second and fourth transistors comprise NMOS transistors, and wherein the second transistor has a width/length ratio larger than one half a width/length ratio of the first transistor, and the third transistor has a width/length ratio more than two times larger than a width/length ratio of the fourth transistor.

23. The current source of claim 22, wherein the second transistor is at least two times the size of the first transistor, and the third transistor is at least ten times the size of the fourth transistor.

24. The current source of claim 21, further comprising:

a fifth transistor having a source terminal coupled to the ground node, a drain terminal coupled to a fifth node and a gate terminal,coupled to the third node; and a sixth transistor having a drain terminal coupled to an output node providing the output current, a source terminal coupled to the fifth node, and a gate terminal coupled to the first node, wherein the fifth transistor and the second transistor form a current mirror such that a current flowing in the fifth and the sixth transistors is derived from a current flowing in the resistor generated by the voltage proportional to absolute temperature.

25. The current source of claim 21, further comprising:

a fifth transistor having a source terminal coupled to the first node, a drain terminal coupled to an output node and a gate terminal coupled to the second node, wherein the fifth transistor provides the output current at the output node that is derived from a current flowing in the resistor generated by the voltage proportional to absolute temperature.

26. The current source of claim 21, wherein the shunt regulator comprises a fifth transistor having a source terminal coupled to the first node, a drain terminal coupled to the ground node and a gate terminal coupled to the fourth node, the fifth transistor regulating the voltage at the first node in response to the input voltage at the fourth node.

27. The current source of claim 21, further comprising an output device for generating the output current at an output node, the output current being derived from a current flowing in the resistor generated by the voltage proportional to absolute temperature, wherein the first current source generates the first current that is derived from and proportional to the current flowing in the resistor.

28. The current source of claim 24, wherein the first current source comprises a current mirror generating the first current by mirroring a current proportional to the current flowing in the resistor.

29. The current source of claim 21, wherein the resistor comprises a polysilicon resistor.

30. The current source of claim 21, wherein the resistor comprises a metal resistor of low temperature coefficient.

31. A method for generating a current proportional to absolute temperature, comprising:

providing a first current powered by a first supply voltage to an inverter pair of transistors having non-nominal transistor size ratio and a pair of diode-connected transistors having non-nominal transistor size ratio;

establishing a first voltage using the inverter pair of transistors;

establishing a second voltage using the pair of diode-connected transistors;

biasing the transistors in the inverter pair and the diode-connected transistors in the subthreshold region;

applying the first voltage and the second voltage across a resistor, wherein the voltage difference between the first voltage and the second voltage causes a voltage proportional to absolute temperature to form across the resistor;

coupling the first voltage to an error amplifier; and using an error signal from the error amplifier to regulate a supply voltage for the inverter pair and the pair of diode-connected transistors.

32. The method of claim 31, wherein the inverter pair of transistors comprises a first PMOS transistor and a second NMOS transistor where the first PMOS transistor is at least ten times larger than the second NMOS transistor; and wherein the pair of diode-connected transistors comprises a third PMOS transistor and a fourth NMOS transistor where the fourth NMOS transistor is at least two times larger than the third PMOS transistor.

33. The method of claim 31, wherein the using an error signal from the error amplifier to regulate a supply voltage for the inverter pair and the pair of diode-connected transistors comprises:

generating the error signal when the first voltage increases to a first predetermined level; and using a shunt regulator to draw a portion of the first current in response to the error signal, wherein as a result of the shunt regulator drawing a portion of the first current, the first voltage decreases to below the first determined level.

34. The method of claim 31, wherein providing a first current comprises generating a current derived from and proportional to a current flowing in the resistor generated by the voltage proportional to absolute temperature.

* * * * *